US005346202A

United States Patent [19]

Jurkewitz

[11] Patent Number: 5,346,202

[45] Date of Patent: Sep. 13, 1994

[54] METHOD OF MONITORING THE TRANSPORT OF PRINT PRODUCTS IN A PRINTING-FIELD MACHINE

[75] Inventor: Manfred Jurkewitz, Wiesloch, Fed. Rep. of Germany

[73] Assignee: Heidelberger Druckmaschinen AG, Heidelberg, Fed. Rep. of Germany

[21] Appl. No.: 41,838

[22] Filed: Apr. 1, 1993

[30] Foreign Application Priority Data

Apr. 2, 1992 [DE] Fed. Rep. of Germany ..... 4210957

[51] Int. Cl.[5] ..... B65H 7/02

[52] U.S. Cl. ..... 271/258; 271/265

[58] Field of Search ..... 271/256, 258, 259, 265, 271/176; 355/316

[56] References Cited

U.S. PATENT DOCUMENTS

| | | | |
|---|---|---|---|
| 4,338,671 | 7/1982 | Korytkowski et al. | 271/259 X |
| 4,408,281 | 10/1983 | Tack, Jr. et al. . | |
| 4,738,442 | 4/1988 | Rodi et al. | 271/261 |
| 4,849,915 | 7/1989 | Worsley et al. | 271/258 X |
| 4,918,627 | 4/1990 | Garcia et al. . | |
| 4,972,354 | 11/1990 | Hauck et al. . | |
| 5,090,318 | 2/1992 | Sugimoto et al. | 271/259 X |
| 5,204,726 | 4/1993 | Choi | 271/258 X |

FOREIGN PATENT DOCUMENTS

| | | |
|---|---|---|
| 0071352 | 2/1983 | European Pat. Off. . |
| 0086097 | 8/1983 | European Pat. Off. . |
| 0095647 | 12/1983 | European Pat. Off. . |
| 0156326 | 10/1985 | European Pat. Off. . |
| 7700430 | 5/1978 | Fed. Rep. of Germany . |
| 3411742 | 10/1985 | Fed. Rep. of Germany . |
| 3725347 | 2/1988 | Fed. Rep. of Germany . |
| 3736163 | 5/1988 | Fed. Rep. of Germany . |
| 3720272 | 12/1988 | Fed. Rep. of Germany . |
| 3730683 | 3/1989 | Fed. Rep. of Germany . |
| 3836310 | 4/1990 | Fed. Rep. of Germany . |
| 1-306247 | 12/1989 | Japan . |
| 1245396 | 9/1971 | United Kingdom . |
| 2115553 | 9/1983 | United Kingdom . |
| 2225556 | 6/1990 | United Kingdom . |

*Primary Examiner*—David H. Bollinger

*Attorney, Agent, or Firm*—Herbert L. Lerner; Laurence A. Greenberg

[57] ABSTRACT

Method of monitoring the transport of print products in a printing-field machine includes, in a first step, forming, in a control device, monitoring zones for leading and trailing edges of a print product, for a zone free of a print product and for a print-product zone, by initially determining the positions of the leading and trailing edges over a defined number of print products and storing them in the control device; by, furthermore, checking the mean values, determined on the basis of measured position values of the leading and trailing edges, as to whether the mean values exceed a given tolerance range; if the tolerance range is exceeded and if a detection system does not produce a signal after the transport device has moved somewhat, re-determining the positions of the leading and trailing edges over a further defined number of print products and storing them in the control device until the mean values are within the tolerance range and, thereafter, defining the monitoring zones in which the signal generated by the detection system for the respective zones may be present; in a second step, determining the actual positions of the edges of all further print products and checking as to whether the respective edges are within the given monitoring zone for the respective edge, and as to whether the print product is within the print-product zone, as to whether the print product is really not within the print-product-free zone, and quickly stopping the machine if the outcome of the check is negative.

2 Claims, 4 Drawing Sheets

METHOD OF MONITORING THE TRANSPORT OF PRINT PRODUCTS IN A PRINTING-FIELD MACHINE

The invention relates to a method of monitoring the transport of print products in a machine employed in the technological field of printing wherein successively transported print products are individually checked by a stationary detecting system and a control device as to whether the individual print products are present at a defined location at a defined instant of time, and as to whether the length of the print product, as well as the space between the print products, deviates from defined reference values. The method of the invention may thus be used for monitoring single-layer print products, such as sheets in a printing machine, for example, as well as multi-layer print products, such as folded products at the delivery or output device of a folder, for example.

The published German Patent Document 37 30 638 A1 describes a method of checking objects wherein the objects are scanned over the respective length thereof, and the values obtained from the scanning are compared with limit values. The objects are conveyed along a conveyor past a scanning device, a plurality of measured values being determined over the length of the respective objects. When respective measured values exceed or fall below the limit values, as the case may be, a signal is generated in a control device, the limit values being varied by values obtained by scanning a reference object over the length thereof, so that a limit value precisely adapted to the signal to be expected thereat is assigned virtually to each location on an object, over the entire length thereof. However, with this heretofore known method, once the limit values are determined, no further variation is provided for, which means that the limit values are not continuously adapted to the process conditions, such as, for example, to the transport speed.

Furthermore, according to the foregoing heretofore known method, almost every point or location on the object is monitored for the purpose of determining whether the measured values thereat, as the case may be, exceed and fall below limit values, respectively, which calls for a considerable outlay in the control device, it being thereby necessary to take into account that the signals produced by the detecting system can be processed without error only if the transport speed does not exceed a given level. Due to the fact that the limit values are derived from precisely one reference object, the method becomes inflexible because these limit values, which may be stored, are only to be used for follow-up orders, of which, on average, the objects correspond to the reference object which, in practice, occurs only rarely.

Moreover, the method exclusively takes into account only the objects which are to be monitored or controlled; it does not, however, monitor the entire transport, including the zones in which the objects are not recognized by the detecting system.

A method of monitoring cyclically recurring production processes which departs from the principle of applying externally determined or given reference values is described in the published German Patent Document 26 43 759 A1. According to this heretofore known method, the data for a proper production cycle is stored and used with successor cycles as close-to-reality reference values. By comparing the respective current actual values with the reference values, a signal, which may initiate an immediate or delayed stepwise stoppage or shutdown of a machine, for example, is given when a permissible deviation has been exceeded. In this heretofore known method, the reference values are obtained directly from the data corresponding to the real production flow and not merely to the data of a single reference cycle. There remains, however, the disadvantage that the reference values are not subject to further modifications once they have been stored as usable and close to reality, provided the conditions, under which the cyclically recurring production processes take place, do not change.

Furthermore, there are heretofore known monitoring methods (German Patent Document 36 13 969 C2, German Utility Model 77 00 430, German Patent Documents 38 36 310 A1 and 37 20 272 A1, Japanese Patent 1-306247 and German Patent Document 34 11 742 A1), wherein one or more detecting systems detect the leading edge and the trailing edge, respectively, of a sheet for monitoring the existence, i.e., the length and the position of the sheet, in a printing-field machine. In a control device, inter alia, the edge signals generated by the detecting system are processed together with the position signals generated by the sheet-conveying device and preferably obtained by incremental angular encoders. For calibrating such a sheet-control device, a suggestion has already been made to detect the positions of the detecting system for a very great number of sheets under process-like conditions, to then average the positions and determine a reference position. With this method and these sheet-control devices, also, the edge signals with respect to their time of occurrence are compared with reference values, which are not adapted or matched to the changing conditions during the control process.

It is accordingly an object of the invention to provide a method of monitoring the transport of print products which permits a continuous adaptation or matching of the upper and lower limit values for the positions of the leading and trailing edges of the print products to continuously changing conditions.

According to the invention this object is achieved in that, in a first step, by means of a detection system past which the print products are conveyed and by means of a position-measuring device measuring the position of a transport device transporting print products, monitoring zones for the leading and trailing edges, a zone free of print product and a print-product zone are formed, the zones being defined only if the mean values of the position-measuring values of the leading and trailing edges of a certain number of print products are within a certain tolerance range. In a modification of the invention, the values stored in a control device and referring to the transport of a previous batch of print products may be used to form monitoring zones, which is a time-saving feature. In a second step, according to the inventive method, the actual positions of the edges of all further print products are determined and checked as to whether the respective edge is within the pre-determined monitoring zone for the respective edge, as to whether the print product is within the print-product zone and as to whether the print product is really not within the zone which is free of a print product; the machine is brought to a quick stop if the outcome of these checks is negative. Furthermore, the spread of the position values of the edges is determined and compared with a limit value, according to this method, a warning signal being produced, if the limit value is exceeded. Furthermore, the method includes the iteration of the aforementioned method steps if a change in transport velocity exceeds a defined amount.

Thus, with the foregoing and other objects in view, there is provided, in accordance with the invention, a method of monitoring the transport of print products in a printing-field machine, which includes, by means of a transport device, conveying similar print products one after the other past at least one stationary detection system for detecting a leading edge and a trailing edge of a print product; by means of a position-measuring device, continuously determining the position of the transport device with respect to a fixed location of the machine; feeding signals from the detection system and from the position-measuring device to a control device containing a computer; continuously determining the position of the print product in the control device with respect to its reference position based upon the signals from the detection system and the position-measuring device; and generating, in the control device, a trouble signal for displaying and for eliminating transport troubles based upon a deviation of the actual position from the reference position of the print product, the trouble signal being generated in accordance with the position of the print product, based upon a mean value averaged over a defined number of print products, and which comprises, in a first step, forming, in the control device, monitoring zones for the leading and trailing edges of the print product, for a zone free of a print product and for a print-product zone, by initially determining the positions of the leading and trailing edges over a defined number of print products and storing them in the control device; by, furthermore, checking the mean values, determined on the basis of the measured position values of the leading and trailing edges, as to whether the mean values exceed a given tolerance range; if the tolerance range is exceeded and if the detection system does not produce a signal after the transport device has moved somewhat, re-determining the positions of the leading and trailing edges over a further defined number of print products and storing them in the control device until the mean values are within the tolerance range and, thereafter, defining the monitoring zones in which the signal generated by the detection system for the respective zones may be present;

in a second step, determining the actual positions of the edges of all further print products and checking as to whether the respective edges are within the given monitoring zone for the respective edge, and as to whether the print product is within the print-product zone, as to whether the print product is really not within the print-product-free zone, and quickly stopping the machine if the outcome of the check is negative; determining the spread of the position values of the edges and comparing it with a limit value; producing a warning signal if the limit value is exceeded; and repeating the foregoing method steps if the change in the transport speed exceeds a defined amount.

In accordance with another mode, the method according to the invention includes forming the monitoring zones in accordance with the values stored in the control device and based upon the transport of a previous number of print products.

The invention permits the transport of print products to be monitored for trouble-free operation. In case of trouble, for example, in the event of a jam or lost print products, a signal indicating the trouble to be eliminated is generated. Due to the fact that the spread of the position values for the edges is also evaluated thereby, the trouble may be recognized in the early stage of its occurrence and may be indicated in the form of a warning signal. It is possible to monitor the transport both at extremely low transport velocities, as well as at maximum transport velocities. This is achieved due to the fact that the monitoring system is self-educating or self-learning, in that the determination of the limits of the monitoring zones, the determination of the monitoring times and the activation of the monitoring process are taken over by the method itself. The monitoring adjusts itself automatically to changing transport conditions, such as, for example, to a change in the transport speed or to the sizes or formats of the print products. When a series of similar print products are being transported, the monitoring optimizes itself constantly.

Other features which are considered as characteristic for the invention are set forth in the appended claims.

Although the invention is illustrated and described herein as a method of monitoring the transport of print products in a printing-field machine, it is nevertheless not intended to be limited to the details shown, since various modifications and changes may be made therein without departing from the spirit of the invention and within the scope and range of equivalents of the claims.

The method of the invention, however, together with additional objects and advantages thereof will be best understood from the following description when read in connection with the accompanying drawings, in which.

Figure 1:
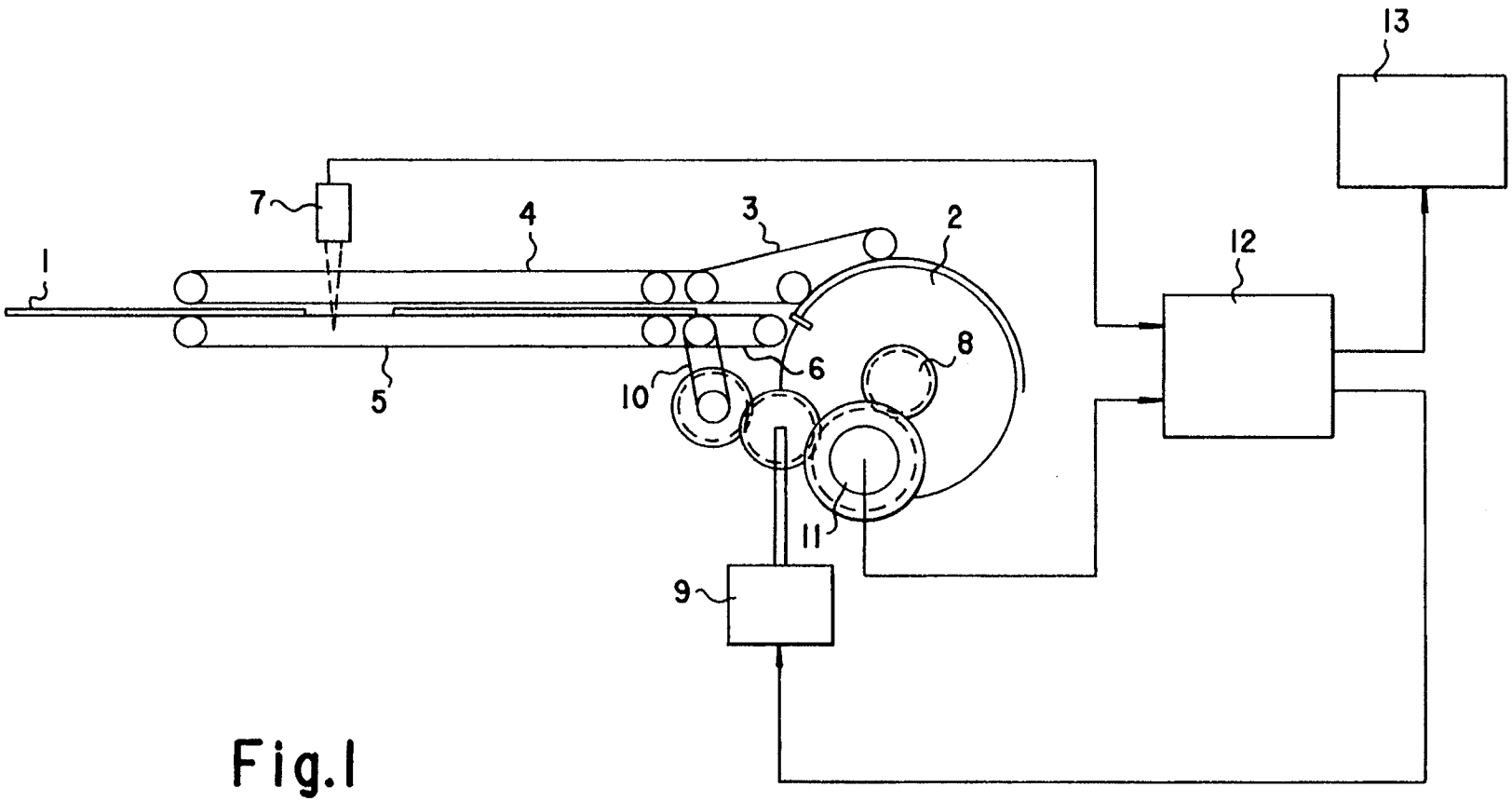
FIG. 1 is a diagrammatic and schematic view of a monitoring system for performing the method according to the invention.

Referring now to the drawing and, first, particulary to FIG. 1 thereof, there is shown therein a monitoring system with which the method according to the invention is performed. In accordance with the illustrated embodiment, folded products 1 are conveyed by conveyor belts 3, 4, 5 and 6 from a cylinder 2 past a stationary detection system 7. The cylinder 2 is rotatably driven, via a gear transmission 8, by a motor 9, the conveyor belts 3, 4, 5 and 6 having a drive sprocket connected to the gear transmission 8 via a belt drive 10. A detection system 7 and an incremental angular encoder 11 are connected to inputs of a control device 12, such as any suitable computer. The control device 12 is provided with an output for driving the motor 9, and another output connected to a display unit 13.

Figure 2:
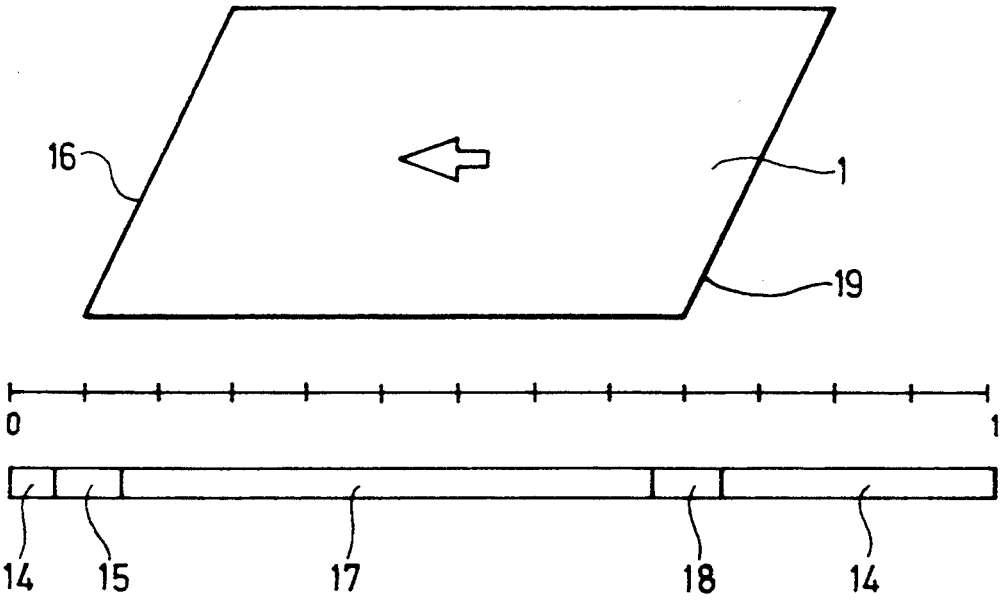
FIG. 2 is a diagrammatic view of a sheet and monitoring zones in accordance with the method.

The method according to the invention is performed with this monitoring system in the manner described hereinafter: In a first step, monitoring zones are formed and stored in the control device 12, as schematically illustrated in FIG. 2. According to FIG. 2, a sequence or series of monitoring zones of a monitoring cycle of a folded product 1 includes a zone 14 in which there should be no folded product 1, a zone 15 in which there may be the leading edge 16, a zone 17 in which there should be the folded product 1, and a zone 18 in which there may be the trailing edge 19 of the folded product 1.

Figure 3:
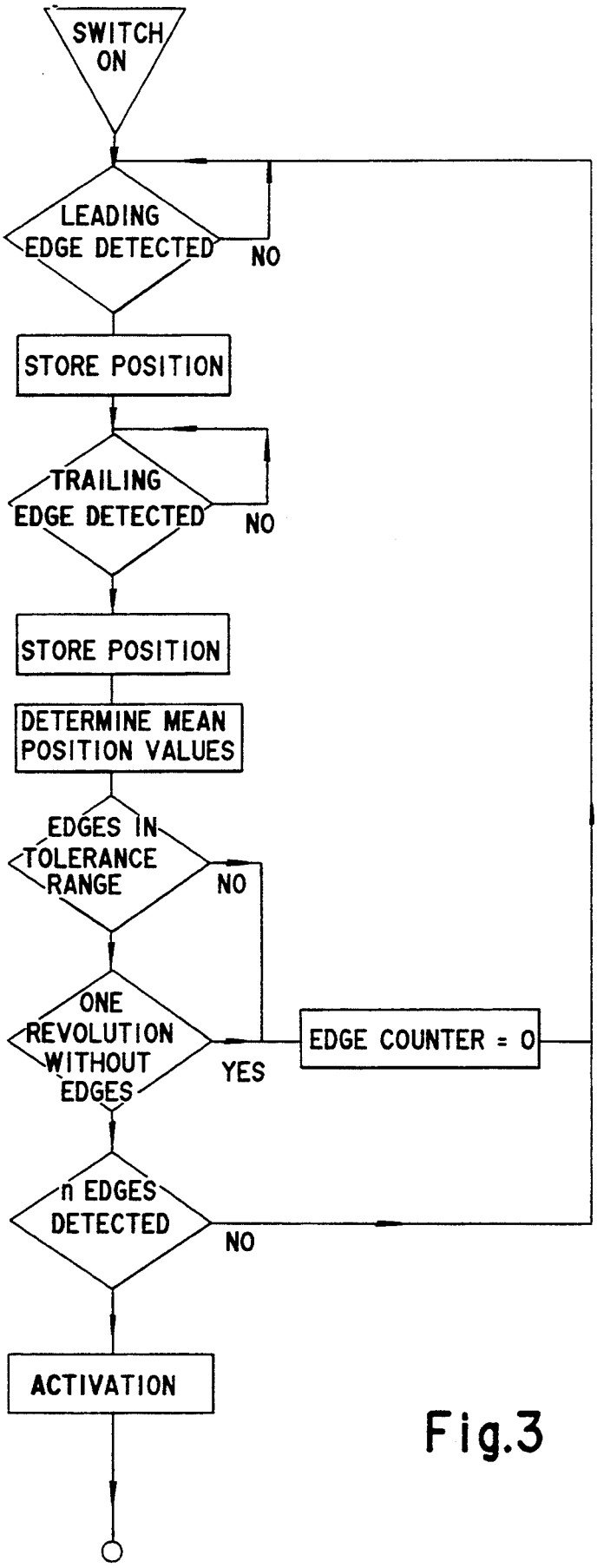
FIG. 3 is a flow chart showing how the monitoring method is activated.

The flow chart in FIG. 3 represents the steps of the method up to the activation of the actual monitoring of the folded products 1. By means of the detection system 7 and the angular encoder 11, the positions of the leading edges 16 and the trailing edges 19 of a plurality of folded products 1 are determined and stored for forming the monitoring zones according to FIG. 2. Mean or average position values are then computed and checked as to whether the measured individual position values of the leading edge 16 and the trailing edge 19 are within a given tolerance range of the average or mean position values. If the measured position values are outside the tolerance range, or if, in a monitoring cycle, the detection system 7 does not detect an edge, an edge-counter is reset in the control device 12, and the aforementioned operations are repeated with respect to a further given number of folded products 1. If the measured position values of the given number of folded products 1 are within the tolerance range, the aforementioned monitoring zones are formed in the control device 12, and the continuous monitoring of the folded products 1 is activated.

Figure 4:
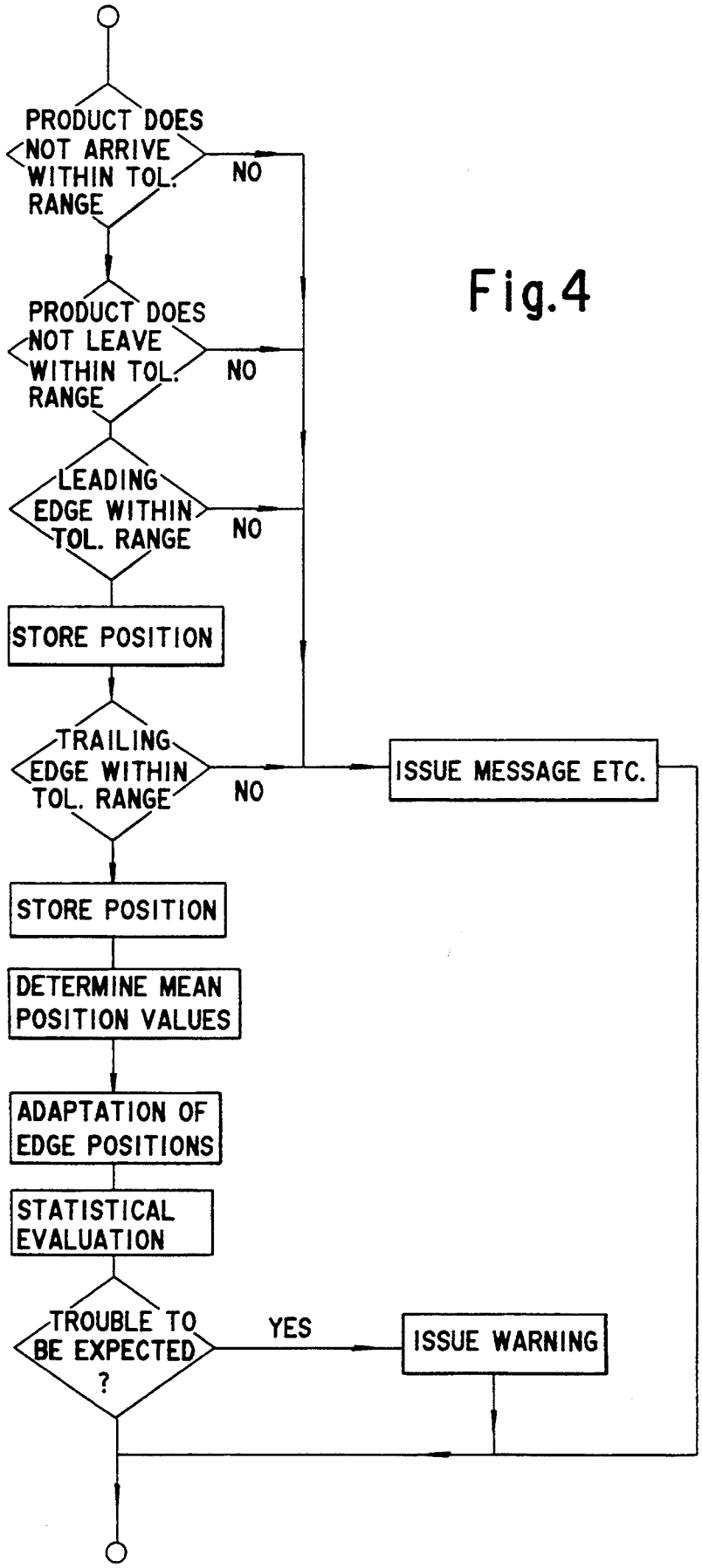
FIG. 4 is a flow chart showing how the monitoring method is continuously performed.

In Accordance with the flow chart shown in FIG. 4, all folded products 1 passing the detection system 7 are checked as to whether the folded product 1 is not present in zone 14, as to whether it is present in zone 17, and as to whether the measured position values of the leading edge 16 and the trailing edge 19 are within the zones 15 and 18. This check is effected by means of the computer integrated in the control device 12. If the outcome of this check is negative, a signal is sent from the control device 12 to the display unit 13 and an adjusting signal to the motor 9, as a result of which the entire folder is quickly stopped. If the outcome of this check is positive, average or mean position values are continuously computed based upon the measured and stored position values of the leading edge 16 and the trailing edge 19. If the mean or average position values drift away somewhat from the bulk or the surface quality of the folded products 1 due to a change in the transport conditions such as, for example, a change in the transport speed, the monitoring zones are re-determined as described hereinabove. Besides determining the mean or average position values, the measured position values are statistically evaluated by computing the spread or dispersion, so that, when the spread or dispersion is too large, the control device 12 delivers a warning signal via the display unit 13. If the transport or conveyance of folded products 1 in several rows extending parallel to one another is to be monitored, it is conceivable to provide a further detection system 7 for each row. The method of monitoring such a multi-track transport is performed as described hereinabove. It is also conceivable to apply the aforementioned method steps for additionally monitoring the misalignment of a relatively wide folded product 1, i.e., with respect to a skewed position thereof, by means of two detection systems 7 directed onto the edges of the relatively wide folded product 1.

The foregoing is a description corresponding in substance to German Application P 42 10 957.4, dated Apr. 2, 1992, the International priority of which is being claimed for the instant application, and which is hereby made part of this application. Any material discrepancies between the foregoing specification and the aforementioned corresponding German application are to be resolved in favor of the latter.

I claim:

1. Method of monitoring the transport of print products in a printing-field machine, which includes:

by means of a transport device, conveying similar print products one after the other past at lest one stationary detection system for detecting a leading edge and a trailing edge of the print product, by means of a position-measuring device, continuously determining the position of the print product with respect to a fixed location of the machine, feeding signals from the detection system and from the position-measuring device to a control device containing a computer, continuously determining the detected position of the print product with the control device with respect to a reference position based upon the signals from the detection system and the position-measuring device, and generating, in the control device, a trouble signal for displaying transport troubles based upon a deviation of the actual position from the reference position of the print produce, the trouble signal being generated in accordance with the position of the print product, based upon a mean value averaged over a defined number of print products, the method which further comprises the steps of:

in a first step, forming, in the control device, monitoring zones for the leading and trailing edges of the print product, for a zone free of a print product and for a print-product zone, by initially determining the positions of the leading and trailing edges over a defined number of print products and storing them in the control device, by, furthermore, forming means values of the measured position values of the leading and trailing edges, determining whether the mean values exceed a given tolerance range; if the tolerance range is exceeded and if the detection system does not produce a signal after the transport device has moved a given distance, re-determining the positions of the leading and trailing edges over a further defined number of print products and storing the re-determined positions in the control device until the mean vales are within the tolerance range and, thereafter, defining the monitoring zones in which the signal generated by the detection system for the respective zones may be present;

in a second step, determining the actual positions of the edges of all further print products and checking as to whether the respective edges are within the given monitoring zone for the respective edge, as to whether the print product is within the print-product zone, as to whether the print product is really not within the print-product-free zone, and quickly stopping the machine if the outcome of the checking is negative;

determining the spread of the position values of the edges and comparing it with a limit value; generating a warning signal if the limit value is exceeded; and repeating the foregoing method steps if the change in the transport sped exceeds a defined amount.

2. Method according to claim 1, which includes forming the monitoring zones in accordance with the values stored in the control device and based upon the transport of a previous number of print products.

* * * * *